US011534039B2

(12) United States Patent
Spencer et al.

(10) Patent No.: US 11,534,039 B2
(45) Date of Patent: Dec. 27, 2022

(54) DEVICE FOR HANDS-FREE LIFTING OF TOILET SEAT

(71) Applicants: Jerry Lynn Spencer, Connelly Springs, NC (US); Phillip Edward Watkins, Hickory, NC (US)

(72) Inventors: Jerry Lynn Spencer, Connelly Springs, NC (US); Phillip Edward Watkins, Hickory, NC (US)

( * ) Notice: Subject to any disclaimer, the term of this patent is extended or adjusted under 35 U.S.C. 154(b) by 0 days.

(21) Appl. No.: 17/370,950

(22) Filed: Jul. 8, 2021

(65) Prior Publication Data

US 2022/0007902 A1 Jan. 13, 2022

Related U.S. Application Data

(60) Provisional application No. 63/049,601, filed on Jul. 8, 2020.

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/300.3
See application file for complete search history.

(56) References Cited

U.S. PATENT DOCUMENTS

| | | | | |
|---|---|---|---|---|
| 4,584,724 | A * | 4/1986 | Wilson | A47K 13/10 4/246.5 |
| 8,230,529 | B1 * | 7/2012 | Reid | A47K 13/10 4/246.5 |
| 9,132,272 | B2 * | 9/2015 | Alves | A61N 1/36057 |
| 2009/0113611 | A1 * | 5/2009 | Jarjour | A47K 13/10 4/246.3 |
| 2013/0263369 | A1 * | 10/2013 | Embler | A47K 13/10 4/246.3 |
| 2021/0393471 | A1 * | 12/2021 | Munton | A47K 13/10 |

* cited by examiner

*Primary Examiner* — Christine J Skubinna
(74) *Attorney, Agent, or Firm* — Jeffrey C. Watson; Grell & Watson Patent Attorneys LLC

(57) ABSTRACT

A device for hands-free lifting of a toilet seat includes an elongated handle portion, a lifting portion and an adjustable angle portion. The lifting portion includes a lifting surface. The lifting surface is sized and configured to be positioned between the toilet seat and the toilet. The adjustable angle portion connects the elongated handle portion to the lifting portion. The adjustable angle portion is configured to adjust an angle between the elongated handle portion and the lifting portion.

19 Claims, 7 Drawing Sheets

DEVICE FOR HANDS-FREE LIFTING OF TOILET SEAT

CROSS-REFERENCE TO RELATED APPLICATIONS

This application claims benefit to U.S. Provisional Patent Application No. 63/049,601, filed on Jul. 8, 2020, entitled "Device for Hands-Free Lifting of Toilet Lid", which is incorporated by reference in its entirety.

FIELD OF THE DISCLOSURE

The present disclosure is related to toilet lid operation. More specifically, the present disclosure is related to a device for hands-free lifting of a toilet seat.

BACKGROUND

Generally speaking, a toilet seat is a hinged unit consisting of a round or oval open seat, and usually a lid, which is bolted onto the bowl of a toilet used in a sitting position (as opposed to a squat toilet). The seat can be either for a flush toilet or a dry toilet. A toilet seat consists of the seat itself, which may be contoured for the user to sit on, and the lid, which covers the toilet when it is not in use, although the lid may be absent in some cases, particularly in public restrooms.

Toilet seats often have a lid and this lid is frequently left open. The combined toilet seat and lid may be kept in a closed position when a toilet is not in use, making it so, at a minimum, the lid must be raised prior to use. It can be closed to prevent small items from falling in, to reduce odors, for aesthetic purposes or to provide a chair in the toilet room. Some studies show that closing the lid prevents the spread of aerosols on flushing ("toilet plume") which might be a source of disease transmission.

Depending on the sex of the user and type of use (urination or defecation) the seat itself may be left either up or down. The issue of whether the seat and lid should be placed in the closed position after use is a perennial topic of discussion and light humor (usually across gender lines), with it often being argued that leaving the toilet seat up is more efficient for men, while putting it down is more considerate for women. The right answer seems to depend on factors ranging from the location of the toilet (public or private), the population of the users (e.g., a sorority house vs frat house) and/or personal or family values, opinions, preferences, agreements or toiletry habits.

Toilet seats often rest not directly on the porcelain or metal body of the toilet itself but upon the hinges and upon tabs/spacers affixed at a few spots. Similarly, lids do not rest directly in uniform contact with the seat but are elevated above it by the hinges and tabs/spacers affixed at a few spots.

One problem that is known is that most toilet seats and/or lids require the user to use their hands to raise and/or lower the toilet seat and/or lid. As one should clearly understand, this is not a very sanitary process to raise and/or lower the toilet seat and/or lid with one's hands whereby any germs, viruses, bacteria, the like, etc. that are present on the toilet and/or lid may be spread to the user's hands. This may be especially problematic in public restrooms or the like where many different users may utilize the toilet. Accordingly, the instant disclosure recognizes the desire and/or need to provide a more sanitary apparatus, means and/or method for raising and/or lowering a toilet seat and/or lid without the need for one to use their hands to touch the seat and/or lid.

The instant disclosure may be designed to address at least certain aspects of the problems or needs discussed above by providing a device for hands-free lifting of a toilet seat.

SUMMARY

The present disclosure may solve the problems of current requirements to manually lift and/or lower a toilet seat and/or lid by providing the disclosed device for hands-free lifting of a toilet seat. Accordingly, in one aspect, the present disclosure embraces a device for hands-free lifting of a toilet seat and/or lid. In general, the disclosed device for hands-free lifting of a toilet seat and/or lid may include an elongated handle portion, a lifting portion and an adjustable angle portion. The lifting portion may include a lifting surface. The lifting surface may be sized and configured to be positioned between the toilet seat and the toilet. The adjustable angle portion may connect the elongated handle portion to the lifting portion. The adjustable angle portion may be configured to adjust an angle between the elongated handle portion and the lifting portion.

One feature of the disclosed device for hands-free lifting of a toilet seat and/or lid may be that the adjustable angle portion can be configured to adjust the angle between the elongated handle portion and the lifting portion in a parallel orientation between the elongated handle portion and the lifting surface.

Another feature of the disclosed device for hands-free lifting of a toilet seat and/or lid may be that the adjustable angle portion can be configured to provide a first adjustable angle and a second adjustable angle. The first adjustable angle may be between the elongated handle portion and the adjustable angle portion. The second adjustable angle may be between the lifting portion and the adjustable angle portion. In select embodiments, the adjustable angle portion may be configured to adjust the first adjustable angle and the second adjustable angle in the parallel orientation between the elongated handle portion and the lifting surface.

In select embodiments of the disclosed device for hands-free lifting of a toilet seat and/or lid, the elongated handle portion may include a first ball and the lifting portion may include a second ball. The first ball may be attached to a first handle end of the elongated handle portion. The second ball may be attached to a first lifting end of the lifting portion. Where the lifting surface may be on a second lifting end of the lifting portion. In these embodiments, the adjustable angle portion may include a two-sided ball connector. The two-sided ball connector may be configured to allow the first ball attached on the elongated handle portion to rotate within a first rotatable connection point of the two-sided ball connector for providing the first adjustable angle between the elongated handle portion and the adjustable angle portion. In addition, the two-sided ball connector may be configured to allow the second ball attached on the lifting portion to rotate within a second rotatable connection point of the two-sided ball connector for providing the second adjustable angle between the lifting portion and the adjustable angle portion. In select embodiments, the two-sided ball connector may include a top half and a bottom half. The top half may have a first top hole and a second top hole. The bottom half may have a first bottom hole and a second bottom hole. Wherein, the top half may be configured to be connected with the bottom half. With the top half connected to the bottom half, the first ball attached on the elongated handle portion may be secured between the first top hole and the first bottom hole, where the first ball may be rotatable within the first top hole and the first bottom hole for the first adjustable angle. Likewise, the second ball attached on the lifting portion may be secured between the second top hole and the second bottom hole, where the second ball may be rotatable within the second top hole and the second bottom hole for the second adjustable angle. In select embodiments, the top half may include a top connector hole and the bottom half may include a bottom connector hole. The top half may include the top connector hole therethrough, where the top connector hole may be between the first top hole and the second top hole. The bottom half may include the bottom connector hole therethrough, where the bottom connector hole may be between the first bottom hole and the second bottom hole. Wherein, the top half may be connected to the bottom half via the top connector hole and the bottom connector hole. In select embodiments, the bottom connector hole may be threaded (or the top connector hole may be threaded). In these embodiments, a screw may be inserted through the top connector hole and rotated into the bottom connector hole for connecting the top half with the bottom half, whereby the screw may be tightened for providing resistance to the adjustable angle portion. In select embodiments, the first ball may be a first stainless-steel ball. The first stainless steel ball may include a first ball hole therethrough configured to receive an elongated stainless-steel rod of the elongated handle portion. Where the first ball may be configured to be affixed to the elongated stainless-steel rod. Likewise, in select embodiments, the second ball may be a second stainless-steel ball. The second stainless steel ball may include a second ball hole therethrough configured to receive a short stainless-steel rod attached to the first lifting end of the lifting portion. Where the second ball may be configured to be affixed to the short stainless-steel rod.

Another feature of the disclosed device for hands-free lifting of a toilet seat and/or lid may be that in select embodiments the elongated handle portion may include an elongated rod. The elongated rod may be connected to the adjustable angle portion at a first handle end. In select embodiments, and clearly not limited thereto, the elongated rod may be an elongated stainless-steel rod with a first stainless-steel ball connected at the first handle end. In select embodiments a knob may be connected to the elongated rod at a second handle end. In select embodiments, and clearly not limited thereto, the knob may be an ultra-high molecular weight plastic knob. The ultra-high molecular weight plastic knob may include a threaded hole therethrough. Wherein, the ultra-high molecular weight plastic knob may be connected to a threaded end on the second handle end of the elongated rod. As examples, and clearly not limited thereto, in select embodiments, the elongated stainless-steel rod may have a handle diameter of 3/32 inches, and the first stainless steel ball may include a first ball hole having a first ball hole diameter of 3/32 inches configured to receive and attach the elongated stainless-steel rod therein, like by welding the first stainless-steel ball on the first handle end of the elongated stainless-steel rod.

Another feature of the disclosed device for hands-free lifting of a toilet seat and/or lid may be that, in select embodiments, the elongated handle portion may include a telescoping rod. The telescoping rod may be configured for adjusting a length of the elongated handle portion.

Another feature of the disclosed device for hands-free lifting of a toilet seat and/or lid may be that, in select embodiments, the lifting surface of the lifting portion may include a self-adhesive pad. The self-adhesive pad may be on a top of the lifting surface. The self-adhesive pad may be configured to removably attach the lifting surface on a bottom side of the toilet seat.

In select embodiments of the disclosed device for hands-free lifting of a toilet seat and/or lid, the lifting portion may include a vertical tab. The vertical tab may be connected on a proximal end of the lifting surface. The vertical tab may be perpendicular to the lifting surface. A short rod may be attached to the vertical tab. The short rod may be perpendicular to the vertical tab and parallel to the lifting surface. With this configuration, the second ball may be attached to a distal end of the short rod. As an example, and clearly not limited thereto, in select embodiments, the short rod may be a short stainless-steel rod with a lifting diameter of 3/32 inches. The second ball may be a second stainless-steel ball. The second stainless-steel ball may include a second ball hole having a second ball hole diameter of 3/32 inches configured to receive and attach the short stainless-steel rod therein, like by welding the second stainless-steel ball on the proximal end of the short stainless-steel rod.

Another feature of the disclosed device for hands-free lifting of a toilet seat and/or lid may be that, in select embodiments, the vertical tab of the lifting portion may be connected on the proximal end of the lifting surface via an angled transition piece. The angled transition piece may be configured to position the lifting surface below the elongated handle portion. In select embodiments, the angled transition piece may include a substantially triangular shape.

Another feature of the disclosed device for hands-free lifting of a toilet seat and/or lid may be that, in select embodiments, the lifting surface may include a thickness configured to fit between the toilet seat and the toilet. As an example, and clearly not limited thereto, the lifting surface may be a stainless-steel plate with the thickness of 0.06 inches.

In another aspect, the present disclosure embraces the disclosed device for hands-free lifting of a toilet seat and/or lid in any of the various embodiment and/or embodiments shown and/or described herein.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-4, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

The present disclosure may solve the problems of current requirements to manually lift and/or lower a toilet seat and/or lid by providing device 10 for hands-free lifting of toilet seat 12, like of toilet 14 (see FIGS. 4A, 4B, 4C and 4D). Accordingly, in one aspect, the present disclosure embraces device 10 for hands-free lifting of toilet seat 12 and/or the associated lid of toilet seat 12 (if present).

Figure 1:
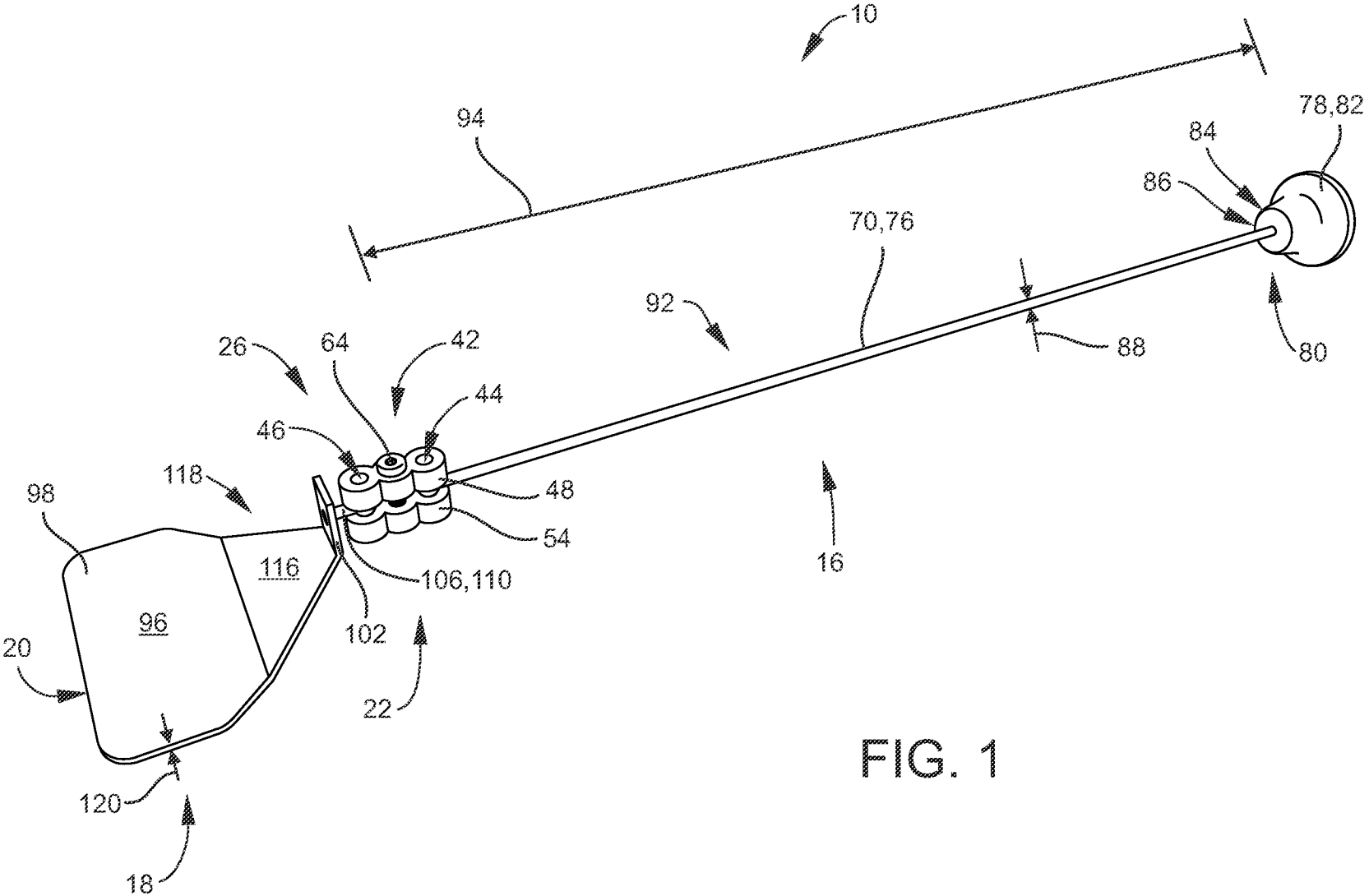
FIG. 1 shows a top perspective view of the device for hands-free lifting of a toilet seat according to select embodiments of the instant disclosure.
Figure 2:
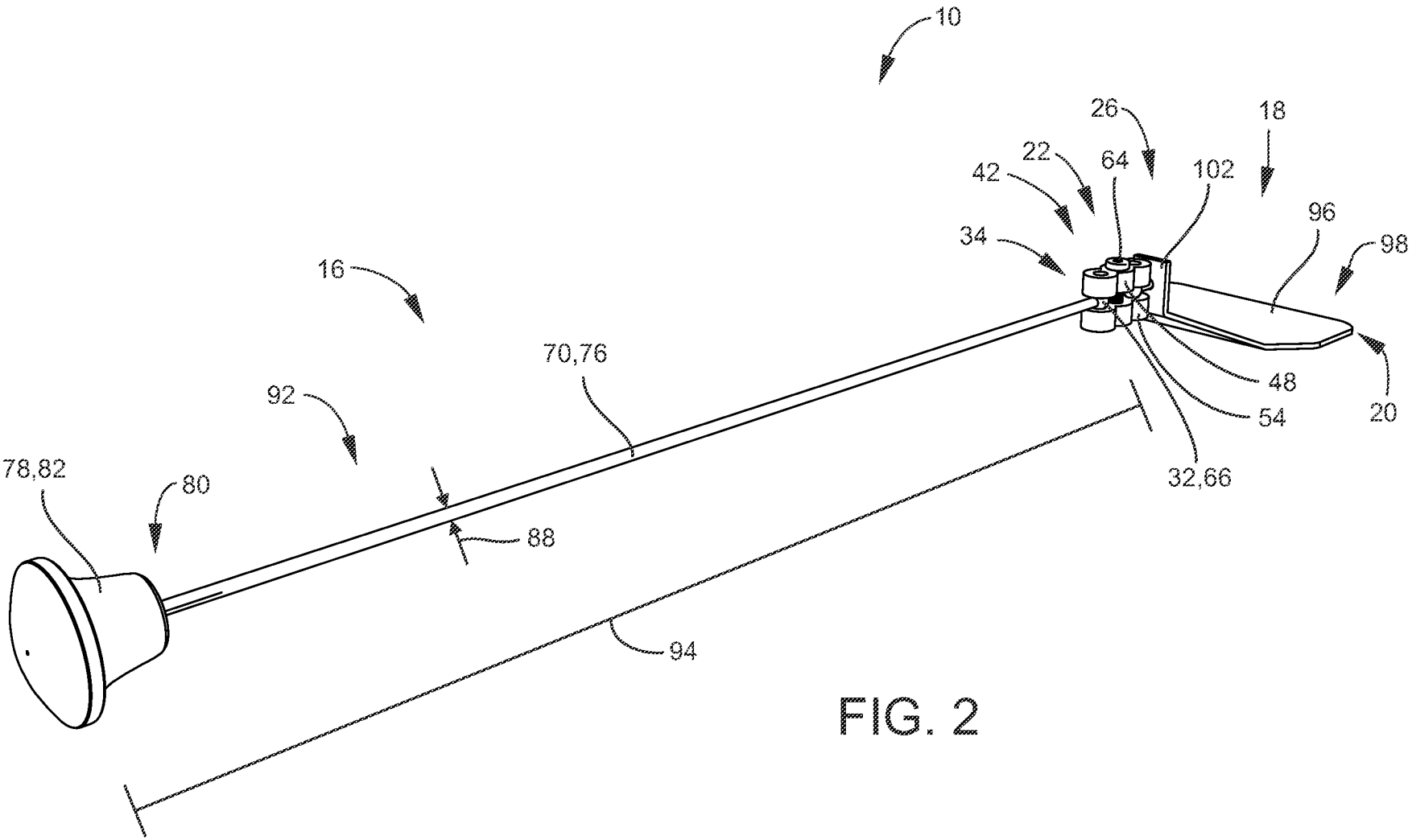
FIG. 2 shows a bottom perspective view of the device for hands-free lifting of a toilet seat from FIG. 1.
Figure 3:
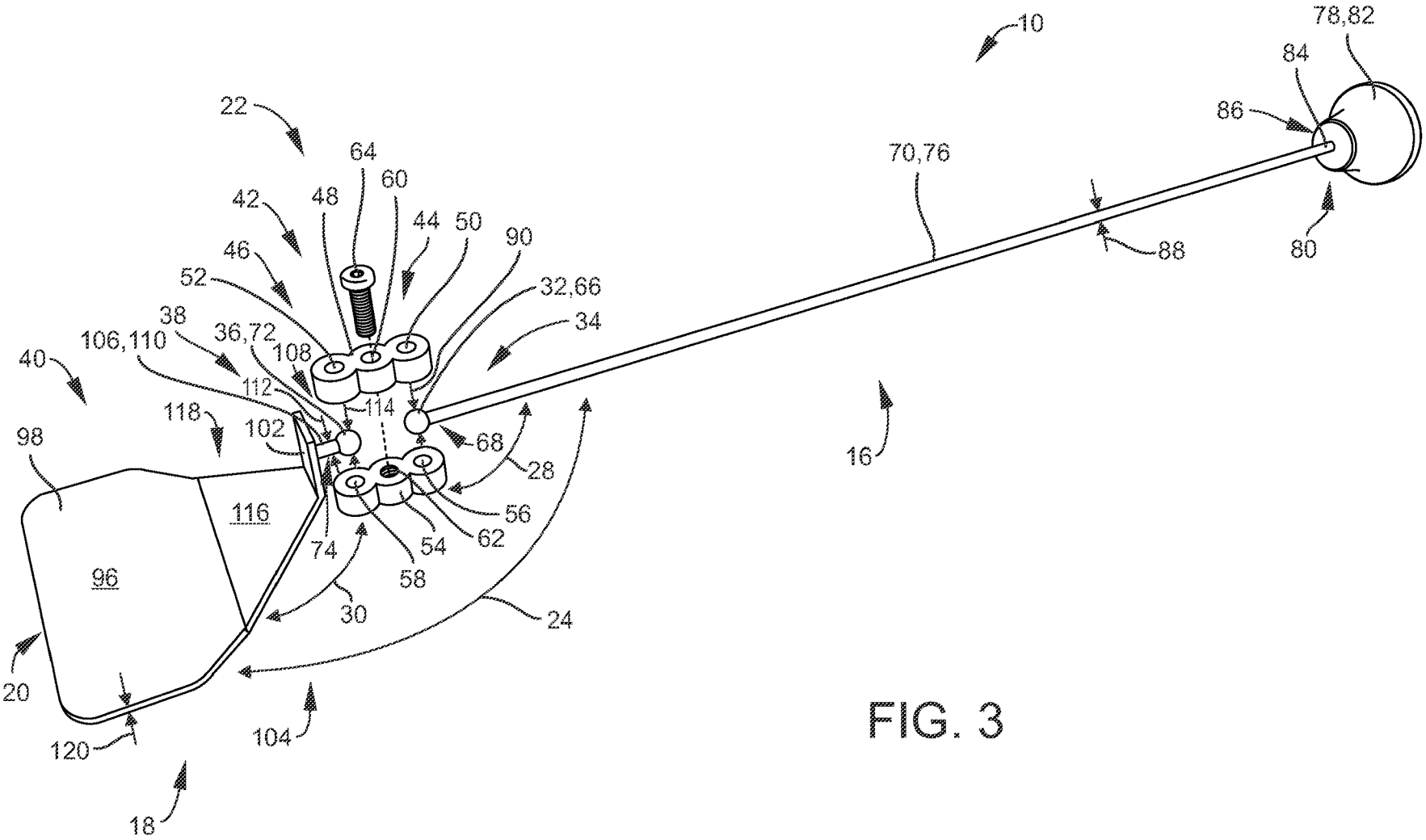
FIG. 3 shows a partially disassembled top perspective view of the device for hands-free lifting of a toilet seat from FIG. 1.

Referring specifically to FIGS. 1-3, in general, device 10 for hands-free lifting of toilet seat 12 and/or lid may include elongated handle portion 16, lifting portion 18, and adjustable angle portion 22. Lifting portion 18 may include lifting surface 20. Lifting surface 20 may be sized and configured to be positioned between toilet seat 12 and toilet 14, like in between the space between bottom 100 of toilet seat 12 and the top of the toilet bowl. This space may be created by spacers or tabs positioned on bottom 100 of toilet seat 12. Accordingly, lifting surface 20 may be inserted into this space, whereby device 10 may be utilized for lifting toilet seat 12 and/or its lid. See FIGS. 4A, 4B, 4C, and 4D. In addition, lifting surface 20 may be sized and configured to be positioned between toilet seat 12 and its lid, like in between the space between the top of toilet seat 12 and the bottom of the lid. This space may be created by spacers or tabs positioned on the bottom of the lid. Accordingly, lifting surface 20 may be inserted into this space, whereby device 10 may be utilized for lifting just the toilet lid. Adjustable angle portion 22 may connect elongated handle portion 16 to lifting portion 18. Adjustable angle portion 22 may be configured to adjust angle 24 between elongated handle portion 16 and lifting portion 18. As such, with adjustable angle portion, device 10 may provide an ergonomical device that is convenient to use and can fit in various size shapes and spaces around toilet 14.

Figure 4A:
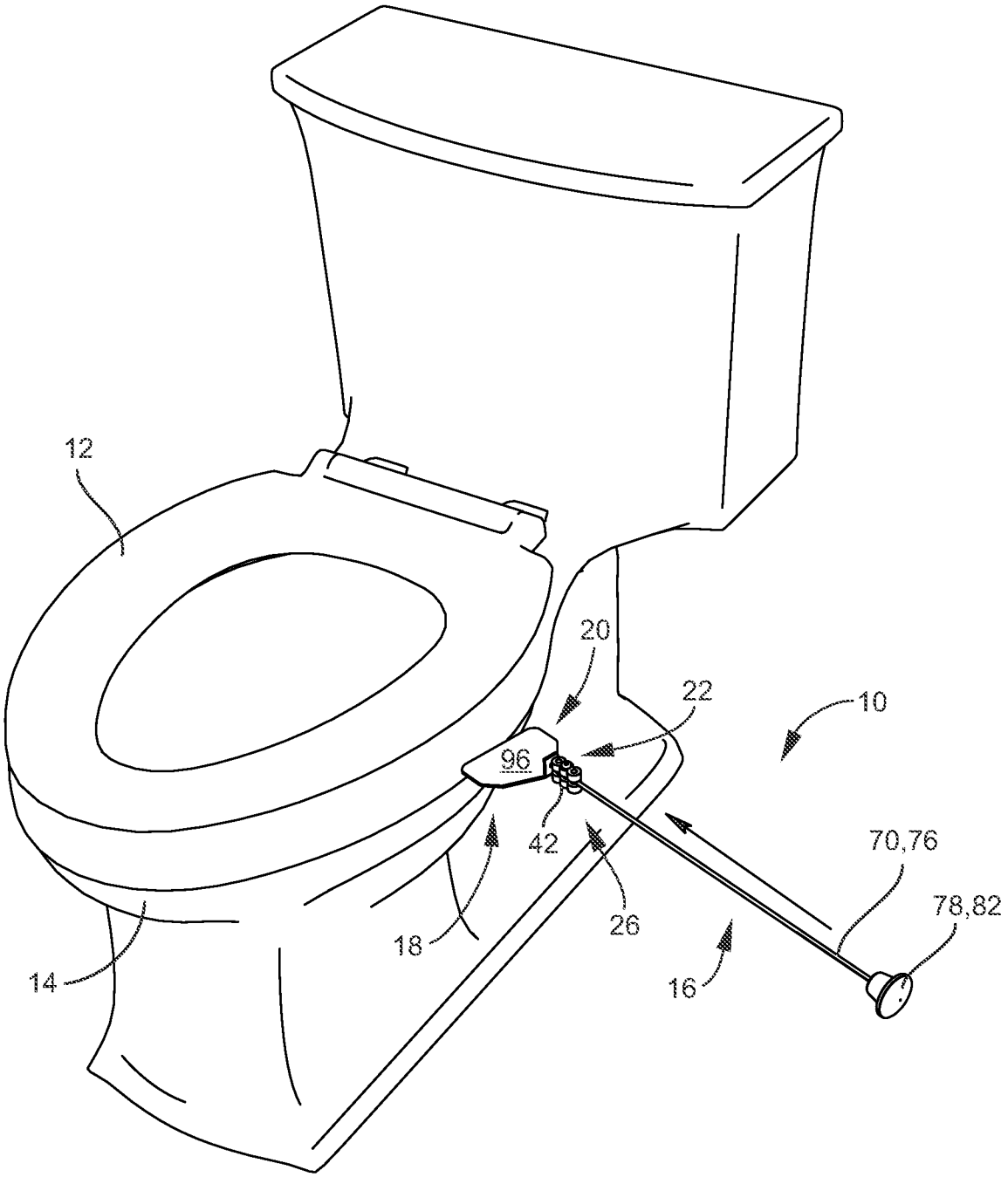
FIG. 4A shows an environmental perspective view of the device for hands-free lifting of a toilet seat according to select embodiments of the instant disclosure being inserted underneath the toilet seat.
Figure 4B:
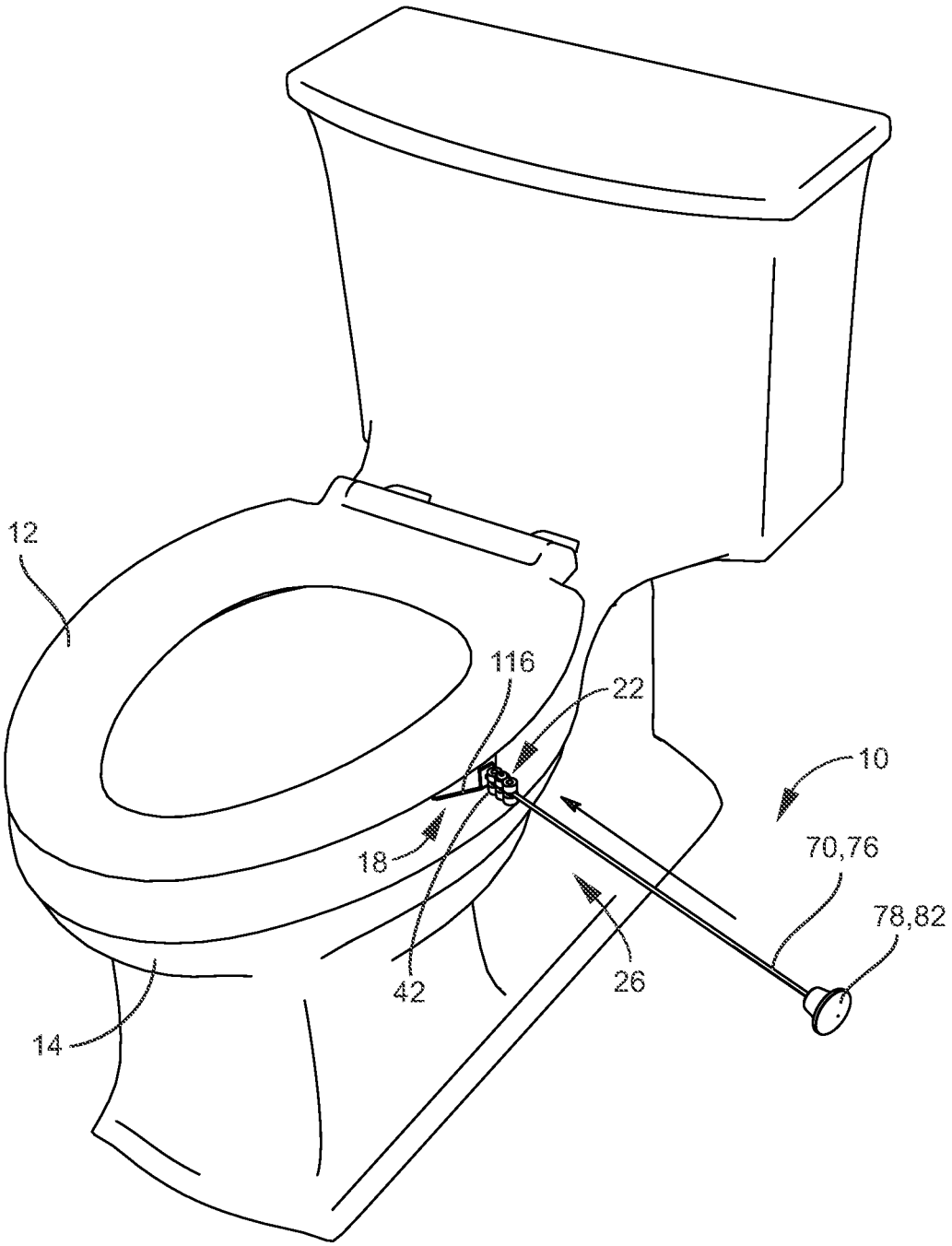
FIG. 4B shows another environmental perspective view of the device for hands-free lifting of a toilet seat of FIG. 4A positioned under the toilet seat.
Figure 4C:
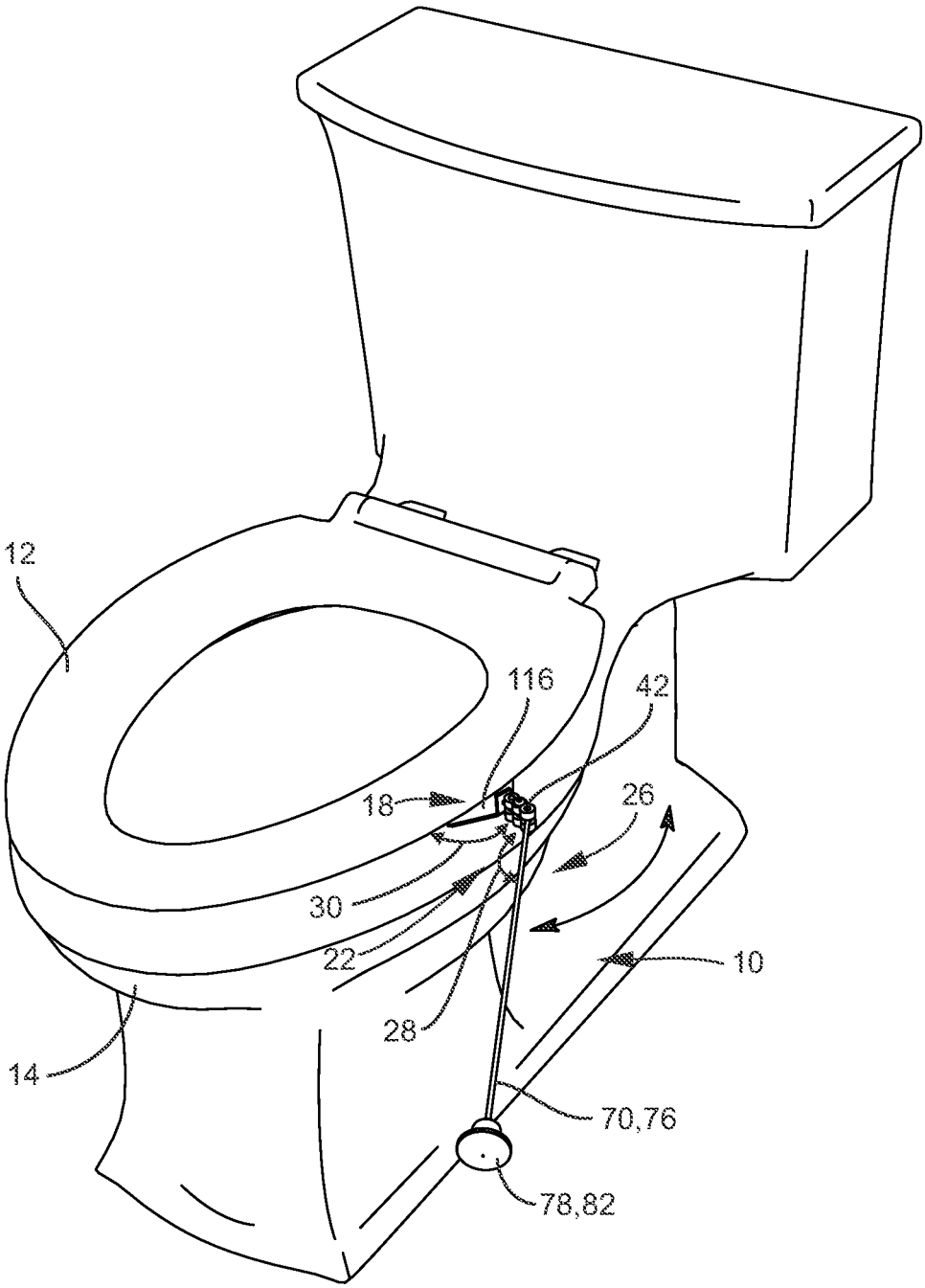
FIG. 4C shows another environmental perspective view of the device for hands-free lifting of a toilet seat of FIG. 4A positioned under the toilet seat with the movement of the angled connection being shown.
Figure 4D:
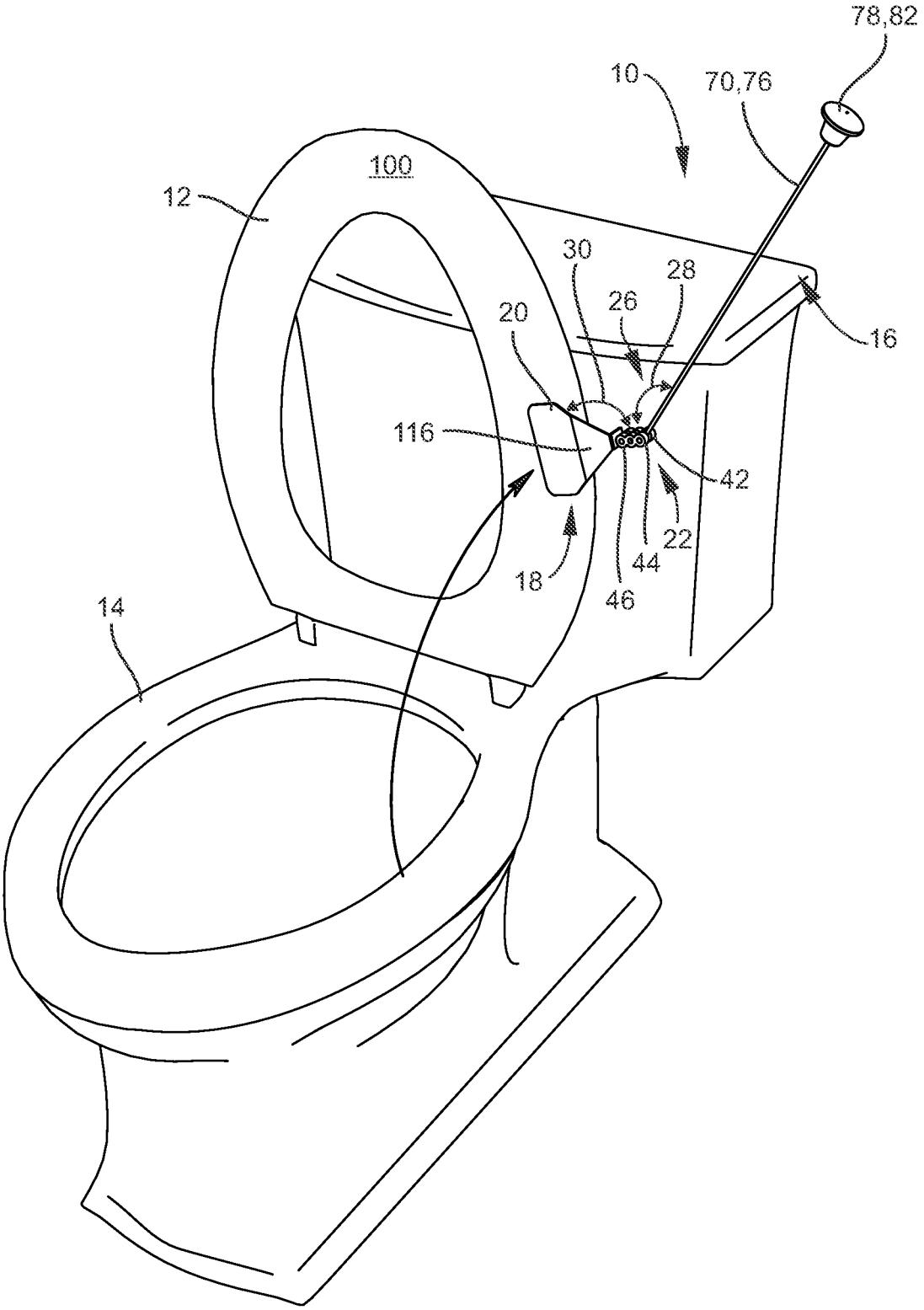
FIG. 4D shows another environmental perspective view of the device for hands-free lifting of a toilet seat of FIG. 4A positioned under the toilet seat and lifting the toilet seat.

As shown in the Figures, namely FIGS. 3, 4C and 4D, one feature of device 10 for hands-free lifting of toilet seat 12 and/or its lid may be that adjustable angle portion 22 can be configured to adjust angle 24 between elongated handle portion 16 and lifting portion 18 in parallel orientation 26 between elongated handle portion 16 and lifting surface 20.

As best shown in FIGS. 3 and 4C, another feature of device 10 for hands-free lifting of toilet seat 12 and/or lid may be that adjustable angle portion 22 can be configured to provide first adjustable angle 28 and second adjustable angle 30. First adjustable angle 28 may be between elongated handle portion 16 and adjustable angle portion 22. Second adjustable angle 30 may be between lifting portion 18 and adjustable angle portion 22. In select embodiments, adjustable angle portion 22 may be configured to adjust first adjustable angle 28 and second adjustable angle 30 in parallel orientation 26 between elongated handle portion 16 and lifting surface 20. Adjustable angle portion 22 may include any device, means, connectors, mechanisms and/or methods for providing adjustable angle 24, including, but not limited to, first adjustable angle 28 and/or second adjustable angle 30. As shown in the Figures, in select embodiments of device 10 for hands-free lifting of toilet seat 12 and/or its lid, elongated handle portion 16 may include first ball 32 and lifting portion 18 may include second ball 36. First ball 32 may be attached to first handle end 34 of elongated handle portion 16. Second ball 36 may be attached to first lifting end 38 of lifting portion 18. Where lifting surface 20 may be on second lifting end 40 of lifting portion 18. In these embodiments, adjustable angle portion 22 may include two-sided ball connector 42. Two-sided ball connector 42 may be configured for making adjustable angle portion 22 be adjustable in 2 positions, like for creating first adjustable angle 28 and second adjustable angle 30. Two-sided ball connector 42 may be configured to allow first ball 32 attached on elongated handle portion 16 to rotate within first rotatable connection point 44 of two-sided ball connector 42 for providing first adjustable angle 28 between elongated handle portion 16 and adjustable angle portion 22. In addition, two-sided ball connector 42 may be configured to allow second ball 36 attached on lifting portion 18 to rotate within second rotatable connection point 46 of two-sided ball connector 42 for providing second adjustable angle 30 between lifting portion 18 and adjustable angle portion 22. The length of two-sided ball connector may be adjusted for providing different lengths between and configurations for first adjustable angle 28 and second adjustable angle 30. In select embodiments, two-sided ball connector 42 may include top half 48 and bottom half 54. Top half 48 may have first top hole 50 and second top hole 52. Bottom half 54 may have first bottom hole 56 and second bottom hole 58. Wherein, top half 48 may be configured to be connected with bottom half 54. With top half 48 connected to bottom half 54, first ball 32 attached on elongated handle portion 16 may be secured between first top hole 50 and first bottom hole 56, where first ball 32 may be rotatable within first top hole 50 and first bottom hole 56 for providing first adjustable angle 28. Likewise, second ball 36 attached on lifting portion 18 may be secured between second top hole 52 and second bottom hole 58, where second ball 36 may be rotatable within second top hole 52 and second bottom hole 58 for providing second adjustable angle 30. In select embodiments, top half 48 may include top connector hole 60 and bottom half 54 may include bottom connector hole 62. Top half 48 may include top connector hole 60 therethrough, where in select possibly preferred embodiments, top connector hole 60 may be between first top hole 50 and second top hole 52, like as shown in the Figures. Bottom half 54 may include bottom connector hole 62 therethrough, where bottom connector hole 62 may be between first bottom hole 56 and second bottom hole 58. Wherein, top half 48 may be connected to bottom half 54 via top connector hole 60 and bottom connector hole 62. Top half 48 may be connected to bottom half 54 may any means. In select embodiments, as shown in the Figures, bottom connector hole 62 may be threaded (or vice versa with top connector hole 60 being threaded). In these embodiments, screw 64 may be inserted through top connector hole 60 and rotated into bottom connector hole 62 for connecting top half 48 with bottom half 54. Whereby, screw 64 may be tightened for providing resistance to adjustable angle portion 22. In select embodiments, first ball 32 may be first stainless-steel ball 66. First stainless-steel ball 66 may include first ball hole 68 therethrough configured to receive elongated stainless-steel rod 70 of elongated handle portion 16. Where first ball 32 may be configured to be affixed to elongated stainless-steel rod 70, like by welding or the like. Likewise, in select embodiments, second ball 36 may be second stainless-steel ball 72. Second stainless-steel ball 72 may include second ball hole 74 therethrough configured to receive short stainless-steel rod 110 attached to first lifting end 38 of lifting portion 18. Where, second ball 36 may be configured to be affixed to short stainless-steel rod 110, like by welding or the like.

Another feature of device 10 for hands-free lifting of toilet seat 12 and/or lid may be that in select embodiments elongated handle portion 16 may include elongated rod 76. Elongated rod 76 may be connected to adjustable angle portion 22 at first handle end 34. Elongated rod 76 may be any desired shape, size, length and/or configuration of an elongated rod or handle for device 10. In select embodiments, and clearly not limited thereto, elongated rod 76 may be elongated stainless-steel rod 70 with first stainless-steel ball 66 connected at first handle end 34. In select embodiments, knob 78 may be connected to elongated rod 76 at second handle end 80. Knob 78 may be included for providing an ergonomical device or means for manipulating device 10. Knob 78 may also include a flat surface for storing device 10 vertically and/or a suction cup end for aiding in storing device 10 vertically, like vertically beside or behind toilet 14. In select embodiments, and clearly not limited thereto, knob 78 may be ultra-high molecular weight plastic knob 82. The ultra-high molecular weight plastic knob 82 may include threaded hole 84 therethrough. Wherein, ultra-high molecular weight plastic knob 82 may be connected to threaded end 86 on second handle end 80 of elongated rod 76. Elongated rod 76 may include handle diameter 88 of any desired size. As examples, and clearly not limited thereto, in select embodiments, elongated stainless-steel rod 70 may have handle diameter 88 of 3/32 inches, and first stainless-steel ball 66 may include first ball hole 68 having first ball hole diameter 90 of 3/32 inches configured to receive and attach elongated stainless-steel rod 70 therein, like by welding first stainless-steel ball 66 on first handle end 34 of elongated stainless-steel rod 70.

Another feature contemplated by the disclosed device 10 for hands-free lifting of toilet seat 12 and/or its lid may be that, in select embodiments, elongated handle portion 16 may include telescoping rod 92. Telescoping rod 92 may be configured for adjusting length 94 of elongated handle portion 16.

Referring now specifically to FIGS. 1, 2, 3, and 4A, another feature of device 10 for hands-free lifting of toilet seat 12 and/or its lid may be that, in select embodiments, lifting surface 20 of lifting portion 18 may include self-adhesive pad 96. Self-adhesive pad 96 may be on top 98 of lifting surface 20. Self-adhesive pad 96 may be configured to removably attach lifting surface 20 on bottom side 100 of toilet seat 12 and/or its lid, like as shown in FIG. 4D.

Referring now to FIGS. 1-3, in select embodiments of device 10 for hands-free lifting of toilet seat 12 and/or its lid, lifting portion 18 may include vertical tab 102. Vertical tab 102 may be connected on proximal end 104 of lifting surface 20. Vertical tab 102 may be perpendicular to lifting surface 20. Short rod 106 may be attached to vertical tab 102. Short rod 106 may be perpendicular to vertical tab 102 and thus parallel to lifting surface 20. With this configuration, second ball 36 may be attached to distal end 108 of short rod 106, like as best shown in FIG. 3. Short rod 106 may include lifting diameter 112 of any desired size. As an example, and clearly not limited thereto, in select embodiments, short rod 106 may be short stainless-steel rod 110 with lifting diameter 112 of 3/32 inches. Second ball 36 may be second stainless-steel ball 72. Second stainless-steel ball 72 may include second ball hole 74 having second ball hole diameter 114 of 3/32 inches configured to receive and attach short stainless-steel rod 110 therein, like by welding second stainless-steel ball 72 on proximal end 104 of short stainless-steel rod 110.

As best shown in FIGS. 1,3, 4B and 4D, another feature of device 10 for hands-free lifting of toilet seat 12 and/or its lid may be that, in select embodiments, vertical tab 102 of lifting portion 18 may be connected on proximal end 104 of lifting surface 20 via angled transition piece 116. Angled transition piece 116 may be configured to position lifting surface 20 below elongated handle portion 16. In select embodiments, angled transition piece 116 may include substantially triangular shape 118, as shown in the Figures.

Referring specifically to FIGS. 1 and 3, another feature of device 10 for hands-free lifting of toilet seat 12 and/or its lid may be that, in select embodiments, lifting surface 20 may include thickness 120. Thickness 120 may be configured to fit between toilet seat 12 and toilet 14. Thickness 120 may be any desired thickness configured to fit between toilet seat 12 and toilet 14, like as shown in FIG. 4B. As an example, and clearly not limited thereto, lifting surface 20 may be a stainless-steel plate with thickness 120 of 0.06 inches.

In another aspect, the present disclosure embraces device 10 for hands-free lifting of toilet seat 12 and/or lid in any of the various embodiment and/or embodiments shown and/or described herein.

In sum, the present disclosure is directed to device 10 configured to provide a sanitary means of lifting and lowering a toilet seat, like toilet seat 12 of toilet 14 shown in the Figures. One advantage of device 10 may be that it can be configured to lift and lower toilet seat 12 and/or its lid without touching toilet seat 12 and/or its lid, i.e., device 10 provides a hands-free tool, device, mechanism, means, etc. for lifting and lowering toilet seat 12 and/or its lid. Another advantage of device 10 may be that it can be configured to lift and lower toilet seat 12 and/or its lid without having to bend over to lift toilet seat 12 and/or its lid. As an example, men that do not normally lower toilet seat 12 and/or lower its lid for the rest of the family (mainly wife and daughters) would be more likely to use device 10. As another example, device 10 may be especially useful for providing a sanitary means of lifting and/or lowering toilet seat 12 and/or its lid in public unisex bathrooms, or in hospital, nursing homes, porta johns, the like, etc. With the inclusion of adjustable angle portion 22, device 10 can be used in tight spaces and hidden discreetly. Another feature of device 10 may be that it can be designed and configured to work on all manufactured toilet seats. Another feature of device 10 may be that it can be designed and/or configured to provide a simple, safe, fast installation, like by just peeling and sticking on a clean surface on bottom side 100 of toilet seat 12. Another feature of device 10 may be that it can be completely assembled and ready to install. Another feature of device 10 may be that al parts can be made of stainless-steel or polished brass to prevent corrosion and ease of cleaning. Another feature of device 10 may be that elongated handle portion 16 can be made from porcelain.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A device for hands-free lifting of a toilet seat of a toilet comprising:

an elongated handle portion;

a lifting portion with a lifting surface, the lifting surface is sized and configured to be positioned between the toilet seat and the toilet; and an adjustable angle portion, the adjustable angle portion connects the elongated handle portion to the lifting portion, the adjustable angle portion is configured to adjust an angle between the elongated handle portion and the lifting portion;

wherein the adjustable angle portion is configured to provide:

a first adjustable angle between the elongated handle portion and the adjustable angle portion; and a second adjustable angle between the lifting portion and the adjustable angle portion;

wherein:

the elongated handle portion including a first ball attached to a first handle end;

the lifting portion including a second ball attached to a first lifting end, where the lifting surface is on a second lifting end of the lifting portion;

the adjustable angle portion including a two-sided ball connector;

the two-sided ball connector is configured to allow said first ball attached on the elongated handle portion to rotate within a first rotatable connection point of said two-sided ball connector for providing the first adjustable angle between the elongated handle portion and the adjustable angle portion; and the two-sided ball connector is configured to allow said second ball attached on the lifting portion to rotate within a second rotatable connection point of said two-sided ball connector for providing the second adjustable angle between the lifting portion and the adjustable angle portion.

2. The device for hands-free lifting of a toilet seat of claim 1, wherein the adjustable angle portion is configured to adjust the angle between the elongated handle portion and the lifting portion in a parallel orientation between the elongated handle portion and the lifting surface.

3. The device for hands-free lifting of a toilet seat of claim 1, wherein the adjustable angle portion is configured to adjust the first adjustable angle and the second adjustable angle in a parallel orientation between the elongated handle portion and the lifting surface.

4. The device for hands-free lifting of a toilet seat of claim 1, wherein the two-sided ball connector including:

a top half with a first top hole and a second top hole;

a bottom half with a first bottom hole and a second bottom hole;

wherein the top half is configured to be connected with the bottom half with:

the first ball attached on the elongated handle portion secured between the first top hole and the first bottom hole, where the first ball is rotatable within the first top hole and the first bottom hole for the first adjustable angle; and the second ball attached on the lifting portion secured between the second top hole and the second bottom hole, where the second ball is rotatable within the second top hole and the second bottom hole for the second adjustable angle.

5. The device for hands-free lifting of a toilet seat of claim 4, wherein the top half including a top connector hole therethrough, the top connector hole is between the first top hole and the second top hole;

the bottom half including a bottom connector hole therethrough, the bottom connector hole is between the first bottom hole and the second bottom hole; and wherein, the top half may be connected to the bottom half via the top connector hole and the bottom connector hole.

6. The device for hands-free lifting of a toilet seat of claim 5, wherein the bottom connector hole is threaded, and a screw is inserted through said top connector hole and rotated into the bottom connected hole for connecting the top half with the bottom half, whereby said screw may be tightened for providing resistance to the adjustable angle portion.

7. The device for hands-free lifting of a toilet seat of claim 1, wherein the first ball is a first stainless-steel ball, the first stainless steel ball includes a first ball hole therethrough configured to receive an elongated stainless-steel rod of the elongated handle portion, where the first ball is configured to be affixed to the elongated stainless-steel rod; and the second ball is a second stainless-steel ball, the second stainless steel ball includes a second ball hole therethrough configured to receive a short stainless-steel rod attached to the first lifting end of the lifting portion, where the second ball is configured to be affixed to the short stainless-steel rod.

8. The device for hands-free lifting of a toilet seat of claim 1, wherein the elongated handle portion including:

an elongated rod connected to the adjustable angle portion at a first handle end; and a knob connected to the elongated rod at a second handle end.

9. The device for hands-free lifting of a toilet seat of claim 8, wherein the elongated rod is an elongated stainless-steel rod with a first stainless-steel ball connected at the first handle end; and the knob is an ultra-high molecular weight plastic knob with a threaded hole therethrough, wherein the ultra-high molecular weight plastic knob is connected to a threaded end on the second handle end.

10. The device for hands-free lifting of a toilet seat of claim 9, wherein the elongated stainless-steel rod has a handle diameter of 3/32 inches, and the first stainless steel ball includes a first ball hole having a first ball hole diameter of 3/32 inches configured to receive and attach the elongated stainless-steel rod therein.

11. The device for hands-free lifting of a toilet seat of claim 1, wherein the elongated handle portion including a telescoping rod configured for adjusting a length of the elongated handle portion.

12. The device for hands-free lifting of a toilet seat of claim 1, wherein the lifting surface of the lifting portion including a self-adhesive pad on a top of the lifting surface, the self-adhesive pad is configured to removably attach the lifting surface on a bottom side of the toilet seat.

13. The device for hands-free lifting of a toilet seat of claim 1, wherein the lifting portion including:

a vertical tab connected on a proximal end of the lifting surface, the vertical tab is perpendicular to the lifting surface;

a short rod attached to the vertical tab, the short rod is perpendicular to the vertical tab and parallel to the lifting surface; and a second ball attached to a distal end of the short rod.

14. The device for hands-free lifting of a toilet seat of claim 13, wherein the short rod is a short stainless-steel rod with a lifting diameter of 3/32 inches;

the second ball is a second stainless-steel ball, the second stainless-steel ball includes a second ball hole having a second ball hole diameter of 3/32 inches configured to receive and attach the short stainless-steel rod therein.

15. The device for hands-free lifting of a toilet seat of claim 13, wherein the vertical tab is connected on the proximal end of the lifting surface via an angled transition piece, the angled transition piece is configured to position the lifting surface below the elongated handle portion, the angled transition piece including a substantially triangular shape.

16. The device for hands-free lifting of a toilet seat of claim 1, wherein the lifting surface including a thickness configured to fit between the toilet seat and the toilet.

17. The device for hands-free lifting of a toilet seat of claim 16, wherein the lifting surface is a stainless-steel plate with the thickness of 0.06 inches.

18. A device for hands-free lifting of a toilet seat comprising:

an elongated handle portion, the elongated handle portion including:

an elongated rod connected to the adjustable angle portion at a first handle end, the elongated rod is an elongated stainless-steel rod with a first stainless-steel ball connected at the first handle end, the elongated stainless-steel rod has a handle diameter, and the first stainless steel ball includes a first ball hole having a first ball diameter configured to receive and attach the handle diameter of the elongated stainless-steel rod therein;

a knob connected to the elongated rod at a second handle end, the knob is an ultra-high molecular weight plastic knob with a threaded hole therethrough, wherein the ultra-high molecular weight plastic knob is connected to a threaded end on the second handle end;

a lifting portion with a lifting surface, the lifting surface including a thickness configured to fit between the toilet seat and the toilet, the lifting surface of the lifting portion including a self-adhesive pad on a top of the lifting surface, the self-adhesive pad is configured to removably attach the lifting surface on a bottom side of the toilet seat, the lifting portion including:

a vertical tab connected on a proximal end of the lifting surface, the vertical tab is perpendicular to the lifting surface, the vertical tab is connected on the proximal end of the lifting surface via an angled transition piece, the angled transition piece is configured to position the lifting surface below the elongated handle portion, the angled transition piece including a substantially triangular shape;

a short rod attached to the vertical tab, the short rod is perpendicular to the vertical tab and parallel to the lifting surface;

a second ball attached to a distal end of the short rod;

an adjustable angle portion, the adjustable angle portion connects the elongated handle portion to the lifting portion, the adjustable angle portion is configured to adjust an angle between the elongated handle portion and the lifting portion, the adjustable angle portion is configured to provide:

a first adjustable angle between the elongated handle portion and the adjustable angle portion;

a second adjustable angle between the lifting portion and the adjustable angle portion;

wherein the adjustable angle portion is configured to adjust the first adjustable angle and the second adjustable angle in a parallel orientation between the elongated handle portion and the lifting surface;

wherein, the adjustable angle portion including a two-sided ball connector, the two-sided ball connector is configured to allow said first ball attached on the elongated handle portion to rotate within a first rotatable connection point of said two-sided ball connector for providing the first adjustable angle between the elongated handle portion and the adjustable angle portion, and the two-sided ball connector is configured to allow said second ball attached on the lifting portion to rotate within a second rotatable connection point of said two-sided ball connector for providing the second adjustable angle between the lifting portion and the adjustable angle portion, wherein the two-sided ball connector including:

a top half with a first top hole and a second top hole;

a bottom half with a first bottom hole and a second bottom hole;

wherein the top half is configured to be connected with the bottom half with:

the first ball attached on the elongated handle portion secured between the first top hole and the first bottom hole, where the first ball is rotatable within the first top hole and the first bottom hole for the first adjustable angle, the first ball is a first stainless-steel ball, the first stainless steel ball includes a first ball hole therethrough configured to receive an elongated stainless-steel rod of the elongated handle portion, where the first ball is configured to be affixed to the elongated stainless steel rod;

the second ball attached on the lifting portion secured between the second top hole and the second bottom hole, where the second ball is rotatable within the second top hole and the second bottom hole for the second adjustable angle, the second ball is a second stainless steel ball, the second stainless steel ball includes a second ball hole therethrough configured to receive a short stainless-steel rod attached to the first lifting end of the lifting portion, where the second ball is configured to be affixed to the short stainless steel rod, the second ball is a second stainless-steel ball, the second stainless-steel ball includes a second ball hole having a second ball diameter configured to receive and attach a lifting diameter of the short stainless-steel rod therein; and wherein, the top half including a top connector hole therethrough, the top connector hole is between the first top hole and the second top hole, the bottom half including a bottom connector hole therethrough, the bottom connector hole is between the first bottom hole and the second bottom hole, wherein, the top half may be connected to the bottom half via the top connector hole and the bottom connector hole, wherein the bottom connector hole is threaded, and a screw is inserted through said top connector hole and rotated into the bottom connected hole for connecting the top half with the bottom half.

19. A device for hands-free lifting of a toilet seat of a toilet comprising:

an elongated handle portion;

a lifting portion with a lifting surface, the lifting surface is sized and configured to be positioned between the toilet seat and the toilet; and an adjustable angle portion, the adjustable angle portion connects the elongated handle portion to the lifting portion, the adjustable angle portion is configured to adjust an angle between the elongated handle portion and the lifting portion;

wherein the lifting portion including:

a vertical tab connected on a proximal end of the lifting surface, the vertical tab is perpendicular to the lifting surface;

a short rod attached to the vertical tab, the short rod is perpendicular to the vertical tab and parallel to the lifting surface; and a second ball attached to a distal end of the short rod.

* * * * *